US005983764A

United States Patent [19]

Hillebrand

[11] Patent Number: 5,983,764

[45] Date of Patent: Nov. 16, 1999

[54] CUTTING DEVICE

[75] Inventor: Bernd Anton Hillebrand, Bergrheinfeld, Germany

[73] Assignee: Koenig & Bauer-Albert Aktiengesellschaft, Wurzburg, Germany

[21] Appl. No.: 08/945,416

[22] PCT Filed: May 13, 1996

[86] PCT No.: PCT/DE96/00828

§ 371 Date: Nov. 20, 1997

§ 102(e) Date: Nov. 20, 1997

[87] PCT Pub. No.: WO96/36488

PCT Pub. Date: Nov. 21, 1996

[30] Foreign Application Priority Data

May 20, 1995 [DE] Germany ..... 195 18 661

[51] Int. Cl.[6] ..... B26D 1/56

[52] U.S. Cl. ..... 83/305; 83/343; 83/698.51; 83/698.61

[58] Field of Search ..... 83/343, 346, 698.41, 83/698.51, 698.61

[56] References Cited

U.S. PATENT DOCUMENTS

| | | | |
|---|---|---|---|
| 4,009,626 | 3/1977 | Gressman . | |
| 4,295,843 | 10/1981 | Otomaru . | |
| 4,467,687 | 8/1984 | Fokos et al. | 83/674 |
| 5,017,184 | 5/1991 | Takahori et al. . | |

FOREIGN PATENT DOCUMENTS

| | | |
|---|---|---|
| 0 364 864 | 4/1990 | European Pat. Off. . |
| WO 94/14612 | 7/1994 | European Pat. Off. . |
| 671 790 | 2/1939 | Germany . |
| 1-97887 | 6/1989 | Japan . |
| 1-121690 | 8/1989 | Japan . |
| 2 040 208 | 8/1980 | United Kingdom . |

*Primary Examiner*—Lee Young
*Assistant Examiner*—Kevin G. Vereene
*Attorney, Agent, or Firm*—Jones, Tullar & Cooper, P.C.

[57] ABSTRACT

A cutting device for transversely cutting a traveling web into signatures is usable to cut signatures into equal or unequal lengths and to accomplish proper register of the cuts. This is accomplished by supporting at least one cutter blade in a cutting cylinder so that the blade can be shifted circumferentially, and by supporting the cutting cylinder so that it can be phase-shifted.

4 Claims, 3 Drawing Sheets

CUTTING DEVICE

FIELD OF THE INVENTION

The present invention relates to a cutting device for transverse cutting of moving webs, in particular in a folding apparatus arranged downstream of a rotary printing press.

A cutting cylinder, having an even number of cutters, is arranged to cooperate with a cylinder having cutter bars. In one mode of operation, first and second cutters are fastened on the cutting cylinder exactly diametrically opposite to each other. In a second mode of operation the first cutter is secured to the cutter cylinder shifted in a circumferential direction with respect to the second cutter by a specific distance or length.

DESCRIPTION OF THE PRIOR ART

EP 0 364 864 A2 describes a cutting device in a folding apparatus of a rotary printing press. In this prior art device the change to different cutting lengths of signatures is performed in that an inner and an outer portion of the cylinder are turned in respect to each other. This is made possible by an additional, second gear train.

An increased structural volume of the cutting cylinder and the need for a second gear train are required by this prior device.

In the prior German document No. DE-C-670 790 there is described a cutting device wherein in a first mode of operation two cutters are arranged diametrically opposite to each other, and in a second mode of operation one of the cutters is disposed offset with respect to the second cutter.

A cutting device having a phase shift between two cylinders, which are taking part in the cutting process, is shown in U.S. Pat. No. 4,009,626. In this prior art device, the phase shift is used to set the length of a section.

SUMMARY OF THE INVENTION

It is the object of the present invention to provide a cutting device for transverse cutting of running webs into signatures, which can be switched from a first mode of operation of "signatures of equal length" to a second mode of operation of "alternating signatures of different lengths".

This object is attained in accordance with the invention by providing a cutting cylinder with an even number of cutters or cutter blades. These cutters are disposed on the cutting cylinder exactly diametrically opposite to each other at 180° when the cutting cylinder is operated in its first or "signatures of equal length" mode. In its second or "alternating signatures of different lengths" mode, the first cutter is shifted circumferentially with respect to the second cutter on the periphery of the cutting cylinder. A phase shift in the circumferential direction is provided between the cutting cylinder and a cooperating cylinder that is provided with cutter bars.

The advantages which can be achieved by the present invention consist in particular in that a simple switch or change of the cutting device from a "non-collecting operation" to a "collecting operation" is possible. In the process, the cutting cylinder can be twisted in respect to the collecting cylinder by means of a simple phase adjustment, which results in time savings and therefore reduces set-up costs. The size and structure of the cutting cylinder are not changed, so that customary cutting cylinders can be used. Existing cutting cylinders with obliquely toothed drive wheels can also be refitted later, since only one axial displacement device for the drive wheel needs to be provided. A correction of the cutting register is also possible by means of the phase-adjustable cutting cylinder.

In addition, so-called chipping can be prevented.

BRIEF DESCRIPTION OF THE DRAWINGS

The cutting device in accordance with the invention is represented in the drawings and will be described in more detail in what follows.

Shown are in.

DESCRIPTION OF THE PREFERRED EMBODIMENT

Figure 1:
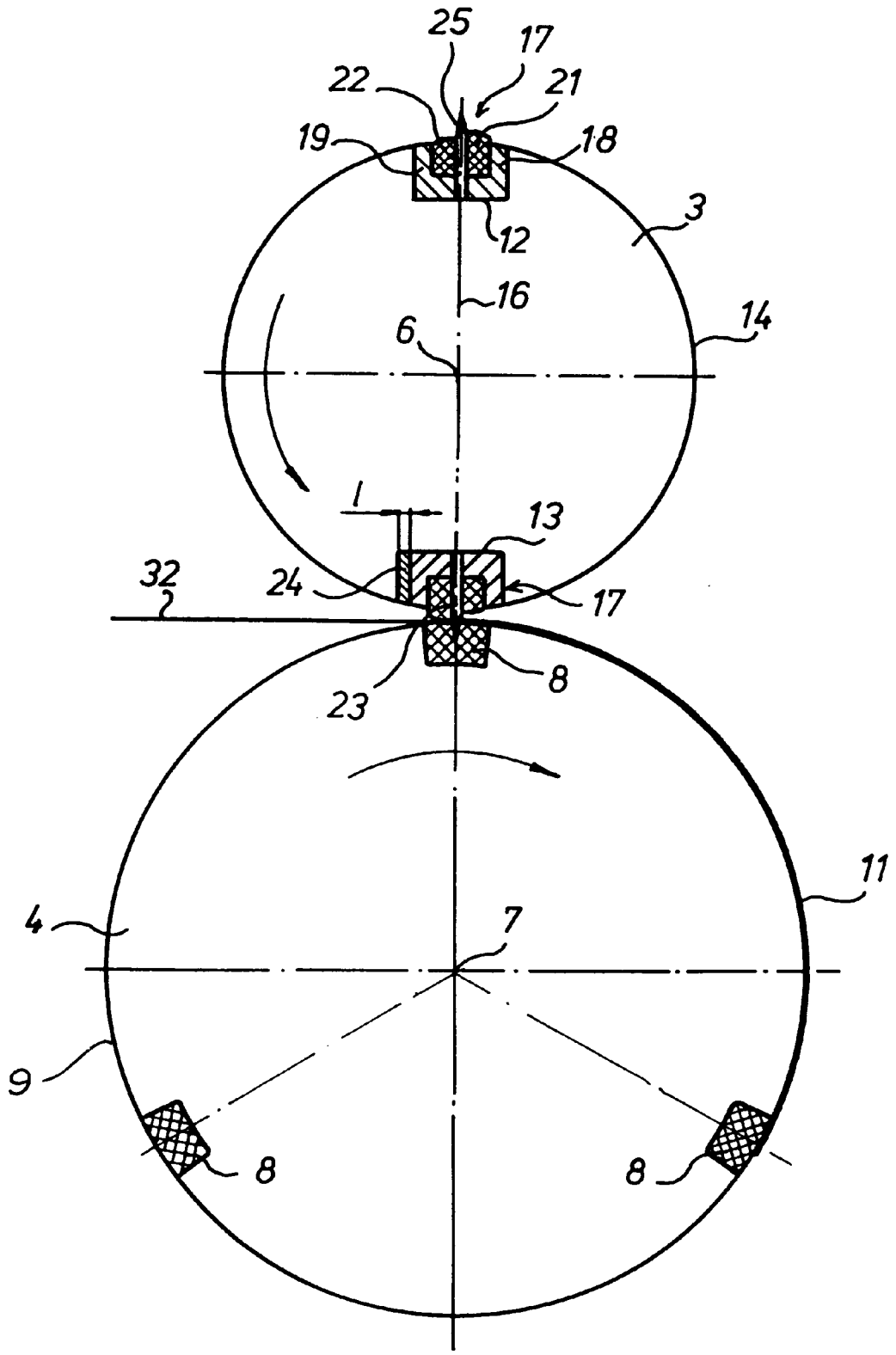
FIG. 1, a schematic, side elevations view of a cutting device in accordance with the present invention in the position of "non-collecting operation", FIG. 2, a schematic, side elevation view of a cutting device in accordance with the present invention in the position of "collecting operation", and FIG. 3 a schematic representation of a drive for a cutting device in accordance with the present invention.
Figure 2:
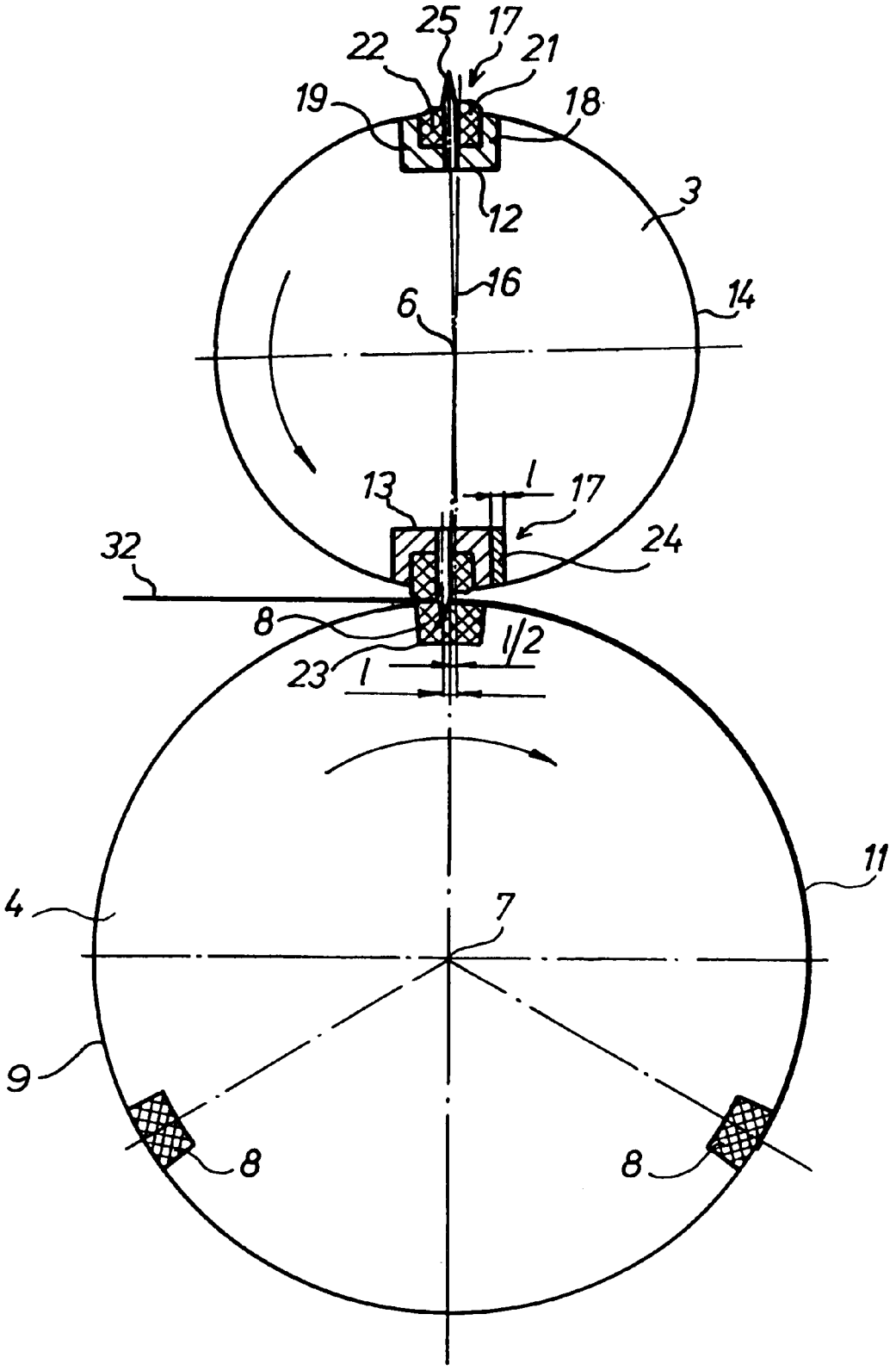

A cutting cylinder 3 and a collecting cylinder 4 are seated, rotatable in the same direction, with respect to a paper web 32 passing therebetween around their respective axes of rotation 6 and 7 extending parallel with each other, in side frames 1, 2 of, for example, a folding apparatus of a rotary printing press. The collecting cylinder 4 is used as the counter cylinder for the cutting cylinder 3 and is therefore provided with cutting bars 8 fixed in place on the cylinder. Three cutting bars 8, which are each offset by 120°, have been provided congruently with a jacket surface 9 of the collecting cylinder 4 and concentrically in respect to the axis of rotation 7 of the collecting cylinder 4. In addition, the collecting cylinder 4 has holding devices, not represented, for example point needles, for holding the signatures 11.

The cutting cylinder 3 is provided with an even number, for example two, of diametrically opposed U-shaped recesses 12 and 13, which each extend parallel with the axis of rotation 6 of the cutting cylinder 3 and have been cut or recessed into a jacket surface 14 of the cutting cylinder 3. The first and second recesses 12 and 13, respectively have a common plane of symmetry 16, which extends through the axis of rotation 6 of the cutting cylinder 3. One recess, such as the second recess 13, has been widened asymmetrically on one side of the plane of symmetry 16 by a length "1" in the circumferential direction parallel with the plane of symmetry 16. Cutter supports 17, which are known per se, are respectively fastened in these first and second recesses 12, 13. Each cutter support 17 essentially consists of two cutter receptacles 18, 19, two elastic pressure elements 21, 22 and a cutter 23 or 25, respectively. Each cutter 23 or 25 is respectively clamped between the cutter receptacles 18, 19 and is laterally supported by the pressure elements 21, 22. A spacer 24 of a thickness d24, which corresponds to the length "1", is disposed in the widened, asymmetric recess 13 and extends parallel with the cutter support 17. This spacer 24 can be selectively placed to the right or left of the cutter support 17 widened recess 13. In a non-collecting position of the cutting cylinder 3, as seen in FIG. 1, the first cutter 23 and the second cutter 25 are fastened exactly offset by 180°, for which purpose the spacer 24 has been placed in the asymmetrically widened portion of the widened recess 13. If the spacer 24 is inserted in the oppositely located portion of the recess 13, i.e. in the non-widened portion of recess 13, the collecting position of the cutting cylinder 3 results, wherein the first cutter 23 has been displaced circumferentially by the length "1" parallel with respect to the plane of symmetry 16. In the collecting position of the cutting cylinder 3, the two jacket surface sections of the cutting cylinder 3 divided by the cutters 23 and 25 are therefore of different lengths.

Figure 3:
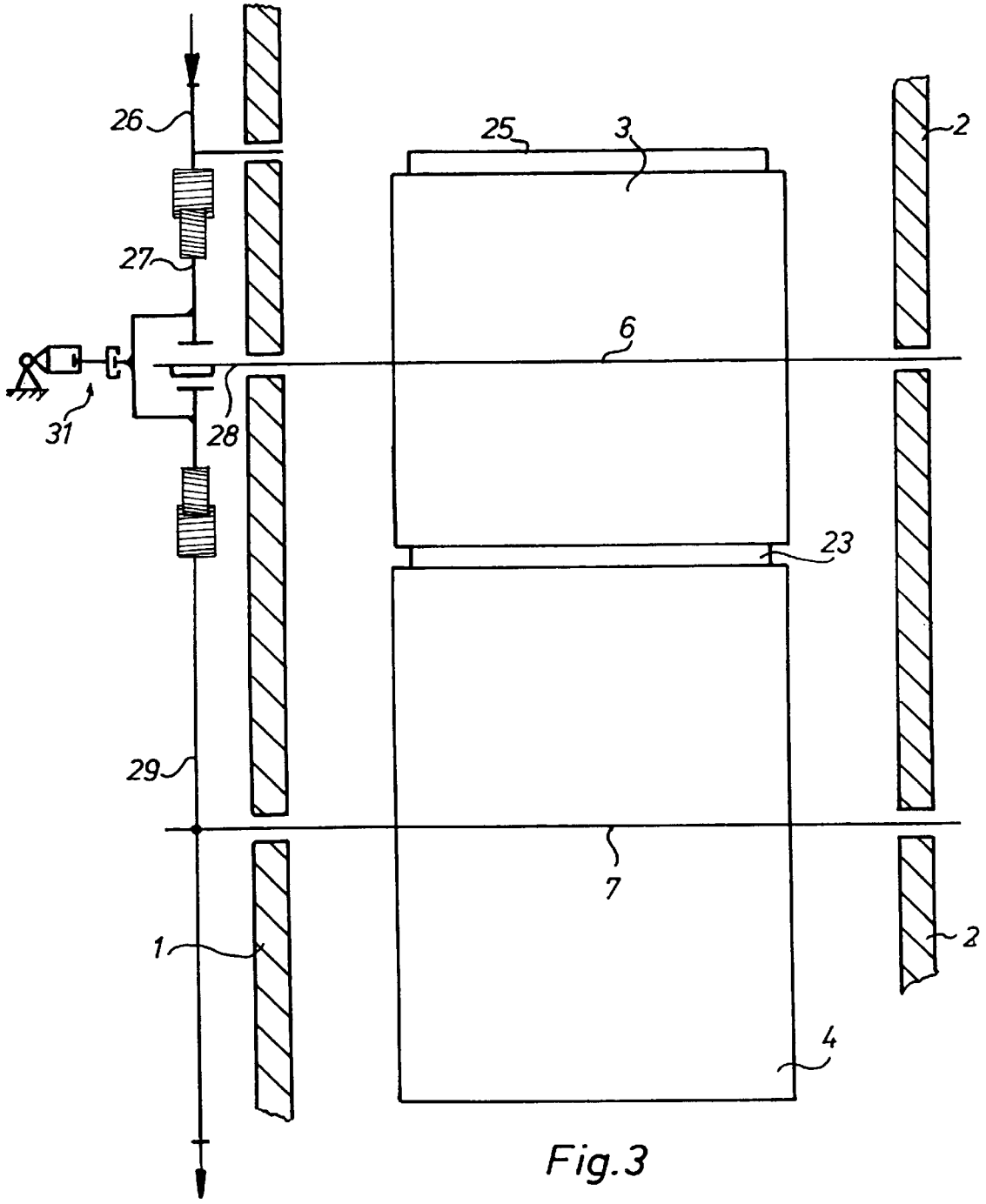

The drive for the cutting cylinder 3 and for the collecting cylinder 4 is provided by a gear located outside the side frame 1, as seen in FIG. 3. A gear wheel 26 of the not represented press drive meshes with an obliquely-toothed gear wheel 27 of the cutting cylinder 3. This oblique toothed gear wheel 27 is connected, fixed against relative rotation, but axially displaceable, with a cylinder journal 28 of the cutting cylinder 3. A drive gear wheel 29 of the collecting cylinder 4, which is rigidly connected with the collecting cylinder 4, meshes in turn with this oblique toothed gear wheel 27. To be able to axially displace the oblique toothed gear wheel 27 of the cutting cylinder 3, an actuator drive 31 is provided which, in the present preferred embodiment, is embodied as a pneumatic cylinder. Other actuator drives 31 can be employed in place of the pneumatic cylinder, in particular those operating in an infinitely variable manner, such as electric motors, linear motors, servo cylinders, etc. The cutting cylinder 3 is turned in its circumferential direction with respect to the collecting cylinder 4 by an axial displacement of the oblique toothed gear wheel 27 of the cutting cylinder 3, i.e. the cutting cylinder 3 and the collecting cylinder 4 are phase-shifted with respect to each other by means of the actuator drive 31.

The mode of operation of the cutting device in accordance with the present invention is as follows:

In the non-collecting position of the cutting cylinder 3, the two cutters 23 and 25 are fastened exactly opposite each other in the cutting cylinder 3. Because of this, the cutting cylinder 3 creates signatures of exactly equal length, the length lNS, on the collecting cylinder 4.

To configure the cutting cylinder 3 into its collecting position, a first cutter 23 is displaced parallel with the plane of symmetry 16, for example by changing the spacer 24 by an amount "1", so that the cutters are no longer lying opposite each other, but are offset from each other by this length "1". The actuator drive 31 of the oblique toothed gear wheel 27 of the cutting cylinder 3 is actuated, because of which the cutting cylinder 3 is phase-shifted in the circumferential direction by means of the obliquely-toothed gear wheel 27 of the cutting cylinder 3. In the present invention this is accomplished by matched sizes of the axial offset of the oblique toothed gear wheel 27 and by an oblique angle of the teeth of the oblique toothed gear wheel 27. By means of this, a web 32 on the collecting cylinder 4 is cut into signatures of alternating length LS1 and LS2. During the collection operation, the length LS1 of the shorter signatures is shorter by the length "1", and the length LS2 of the longer signatures is longer by the length "1", than the length 1NS of the signatures of equal length during the non-collecting operation. By phase-shifting the cutting cylinder 3 by the length ½, which corresponds to one half of the offset of the cutters 23, 25, it is achieved that respectively both ends of the signatures are evenly cut longer or shorter by the length ½.

This phase shift can be adjustable for changing the cutting register, preferably within a range from 0 to ½. This adjustment of the cutting register can preferably be performed in an infinitely variable manner.

While a preferred embodiment of a cutting device in accordance with the present invention has been set forth fully and completely hereinabove, it will be apparent to one of skill in the art that a number of changes in, for example, the type of printing press used to print the web, the type of cutter blades used, the cut web grippers and the like can be made without departing from the true spirit and scope of the present invention, which is accordingly to be limited only by the following claims.

What is claimed is:

1. A cutting device for the transverse cutting of a moving web into signatures in a folding apparatus of a rotary printing press comprising:

a cutting cylinder;

an even number of cutters secured to said cutting cylinder;

a collecting cylinder having cutter bars, said cutter bars cooperating with said cutters;

means to shift a first one of said even number of cutters with respect to a second one of said even number of cutters in a circumferential direction on said cutting cylinder by a first length; and means to phase shift in said circumferential direction said cutting cylinder with respect to said collecting cylinder by an adjustable phase shift amount, said adjustable phase shift amount being up to one half of said first length.

2. A cutting device for the transverse cutting of a moving web into signatures in a folding apparatus of a rotary printing press comprising:

a cutting cylinder;

an even number of cutters secured to said cutting cylinder;

a collecting cylinder having cutter bars, said cutter bars cooperating with said cutters;

means to shift a first one of said even number of cutters with respect to a second one of said even number of cutters in a circumferential direction on said cutting cylinder by a first length;

means to phase shift in said circumferential direction said cutting cylinder with respect to said collecting cylinder; and a cylinder journal supporting said cutting cylinder and an obliquely tooth gear wheel fixed against relative rotation on, and with respect to, said cylinder journal, said obliquely toothed gear wheel being axially shiftable on said cylinder journal, and further including an actuator device for shifting said obliquely toothed gear wheel on said cutting cylinder journal.

3. The cutting device of claim 2 wherein said actuator drive is a pneumatic cylinder.

4. A cutting device for the transverse cutting of a moving web into signatures in a folding apparatus of a rotary printing press comprising:

a cutting cylinder;

an even number of cutters secured to said cutting cylinder;

a collecting cylinder having cutter bars, said cutter bars cooperating with said cutters;

means to shift a first one of said even number of cutters with respect to a second one of said even number of cutters in a circumferential direction on said cutting cylinder by a first length;

means to phase shift in said circumferential direction said cutting cylinder with respect to said collecting cylinder;

cutter receiving recesses in said cutting cylinder, and cutter supports positionable in said recesses and each receiving one of said cutters; and a spacer receivable in at least one of said cutter receiving recesses and usable to shift said cutter support in said cutter receiving recess circumferentially on said cutting cylinder.

* * * * *